US012442592B2

(12) United States Patent
Kim

(10) Patent No.: US 12,442,592 B2
(45) Date of Patent: Oct. 14, 2025

(54) HOME APPLIANCE

(71) Applicant: LG ELECTRONICS INC., Seoul (KR)

(72) Inventor: Minkyu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 268 days.

(21) Appl. No.: 18/139,453

(22) Filed: Apr. 26, 2023

(65) Prior Publication Data

US 2023/0349629 A1 Nov. 2, 2023

(30) Foreign Application Priority Data

Apr. 28, 2022 (KR) ..... 10-2022-0052905

(51) Int. Cl.
*F25D 29/00* (2006.01)
*F25C 5/20* (2018.01)
*F25D 23/12* (2006.01)

(52) U.S. Cl.
CPC ..... *F25D 29/005* (2013.01); *F25C 5/22* (2018.01); *F25D 23/126* (2013.01)

(58) Field of Classification Search
CPC ..... B67D 1/124; F25D 29/005; H01H 13/14
USPC ..... 222/182, 505; 141/362, 351
See application file for complete search history.

(56) References Cited

U.S. PATENT DOCUMENTS 4,209,999 A * 7/1980 Falk ..... F25C 5/22 200/61.7
6,425,425 B2 * 7/2002 Bianchi ..... B67D 1/0085 141/351
7,958,742 B2 * 6/2011 Park ..... F25D 23/126 62/389
8,820,583 B2 * 9/2014 Kim ..... F25C 5/22 220/811
9,182,167 B2 * 11/2015 Park ..... F25D 23/028
2010/0319388 A1 * 12/2010 Yang ..... F25D 23/126 62/449

* cited by examiner

*Primary Examiner* — Paul R Durand
*Assistant Examiner* — Randall A Gruby
(74) *Attorney, Agent, or Firm* — KED & ASSOCIATES

(57) ABSTRACT

A home appliance including a dispenser housing recessed into a door thereof, a dispenser nozzle disposed in an upper area of the dispenser housing and configured to discharge liquid, such as water, or ice, a dispenser button disposed in the dispenser housing and configured to operate the dispenser nozzle, and a button cover detachably coupled to a front surface of the dispenser button and configured to cover the dispenser button.

13 Claims, 7 Drawing Sheets

HOME APPLIANCE

CROSS-REFERENCE TO RELATED APPLICATION(S)

This application claims priority to and the benefit of Korean Patent Application No. 10-2022-0052905, filed in Korea on Apr. 28, 2022, the disclosure of which is incorporated herein by reference in its entirety.

BACKGROUND

1. Field

A home appliance, more particularly, a home appliance including a dispenser configured to dispense liquid, such as water, or ice is disclosed herein.

2. Background

A home appliance, such as a refrigerator and a water purifier, is provided with a dispenser configured to dispense liquid, such as water, or ice. Such as dispenser includes a button configured to be pressed to operate by a container for containing liquid, such as water, or ice, for example, a cup.

As the button is pressed by a container and directly comes into contact with the container, the dispenser button has a relatively large area and has a possibility of being contaminated by splash of contents contained in the container. If the contents of the container are pure water, there is no problem. However, if the contents are beverages, such as coffee or soda water, some of the contents might splash and get onto the dispenser button, which is not aesthetically pleasing. When the splashed contents are left unattended, bacteria might propagate.

BRIEF DESCRIPTION OF THE DRAWINGS

Embodiments will be described in detail with reference to the following drawings in which like reference numerals refer to like elements, and wherein.

DETAILED DESCRIPTION

Figure 1:
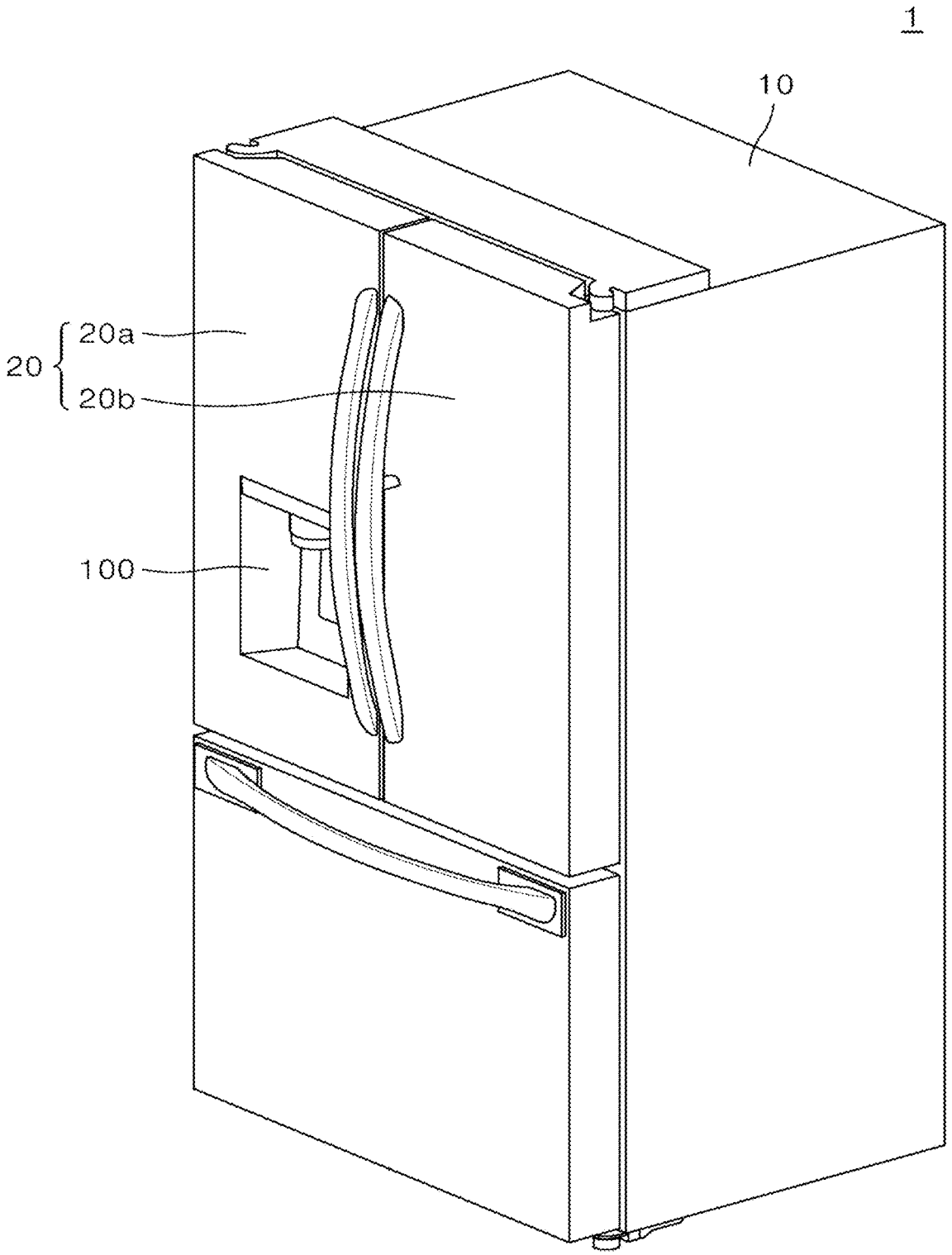
FIG. 1 is a perspective view of a home appliance according to an embodiment.

Aspects, features, and advantages are specifically described hereinafter with reference to the accompanying drawings such that one having ordinary skill in the art to which embodiments pertain may easily implement the technical spirit. Herein, description of known technologies is omitted if it is deemed to make the gist unnecessarily vague. Hereinafter, embodiments are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout, each component can be provided as a single one or a plurality of ones, unless explicitly stated to the contrary.

Hereinafter, expressions of 'a component is provided or disposed in an upper or lower portion' may mean that the component is provided or disposed in contact with an upper surface or a lower surface. The present disclosure is not intended to limit that other elements are provided between the components and on the component or beneath the component.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Throughout, the terms "A and/or B" as used herein can denote A, B or A and B, and the terms "C to D" can denote C or greater and D or less, unless stated to the contrary.

Hereinafter, referring to the accompanying drawings, a home appliance according to embodiments will be described.

A dispenser according to embodiments may be applied to a home appliance, such as a refrigerator and a water purifier. In this embodiment, a refrigerator as one example is disclosed.

FIG. 1 is a perspective view of a home appliance according to an embodiment. The home appliance 1 according to this embodiment may include a case 10 defining a storage chamber and a door 20 rotatably coupled to the case 10 to open and close the storage chamber. The door 20 may include a left or first door 20*a*, a right or second door 20*a*, and a dispenser module 100 disposed in the left door 20*a* and configured to dispense liquid, such as water, or ice.

Figure 2:
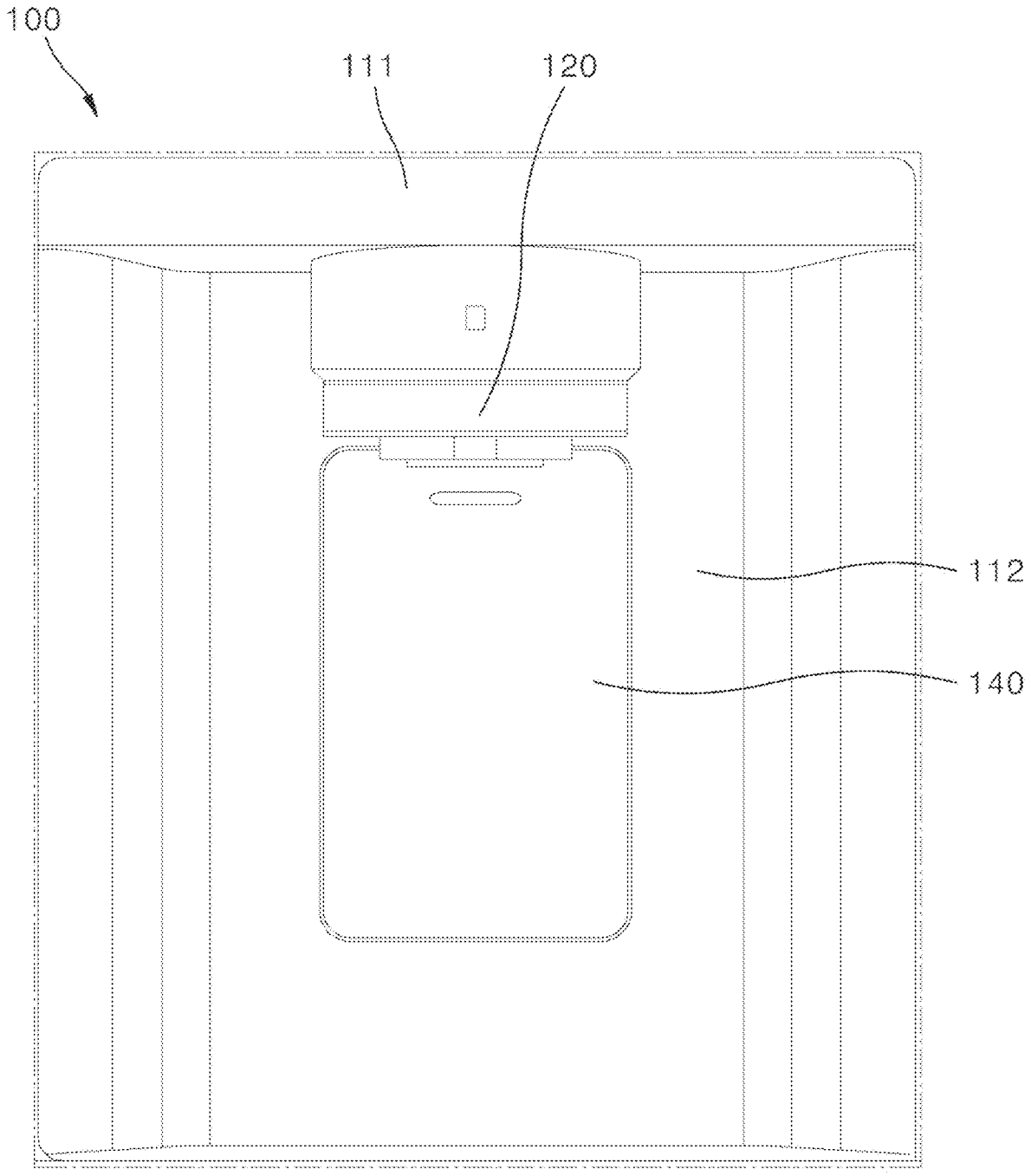
FIG. 2 is a front view of a dispenser module provided in the home appliance shown in FIG. 1.
Figure 3:
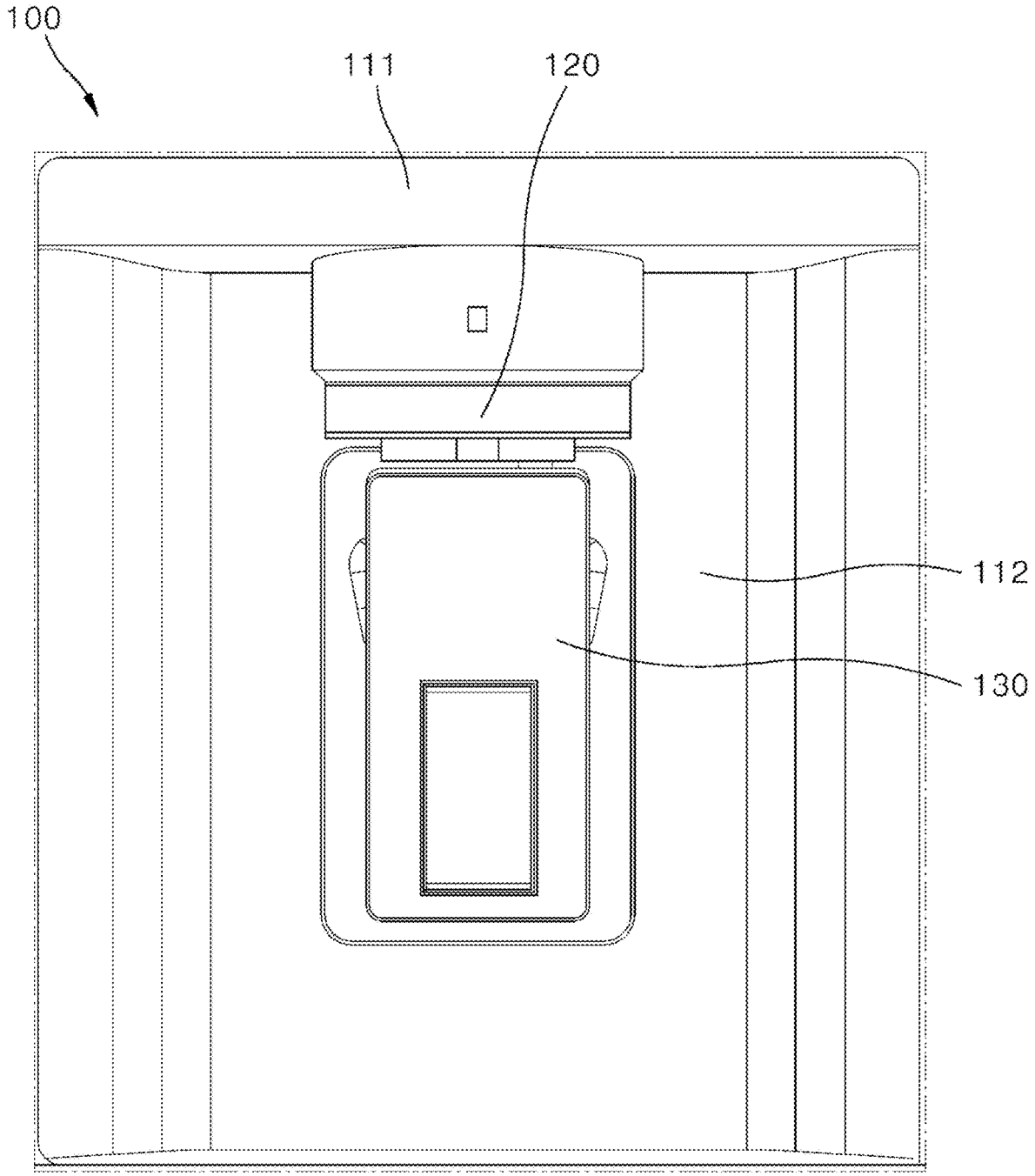
FIG. 3 is a front view of a state in which a cover is demounted from the dispenser shown in FIG. 2.
Figure 4:
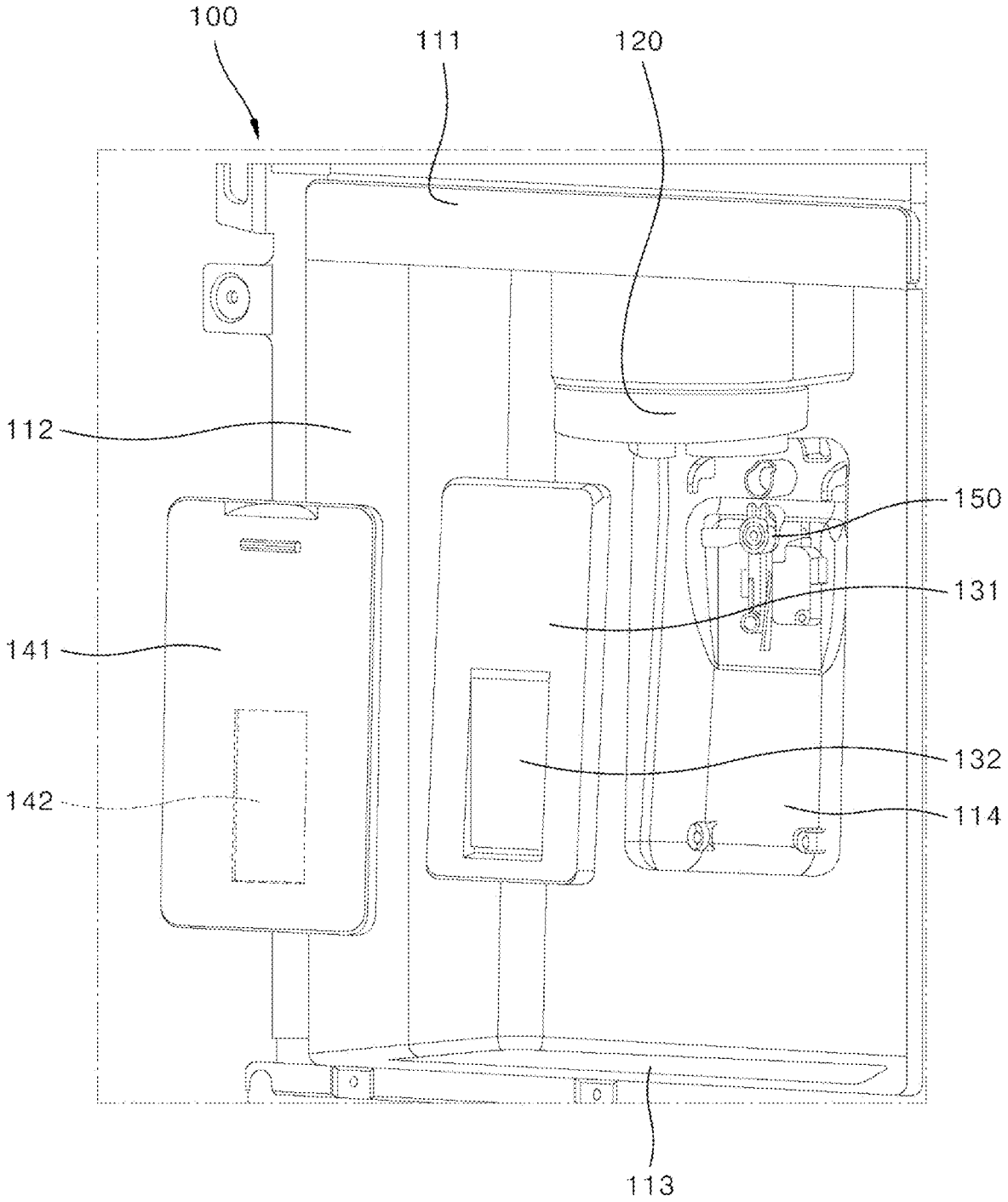
FIG. 4 is an exploded perspective view of the dispenser module shown in FIG. 1.
Figure 5:
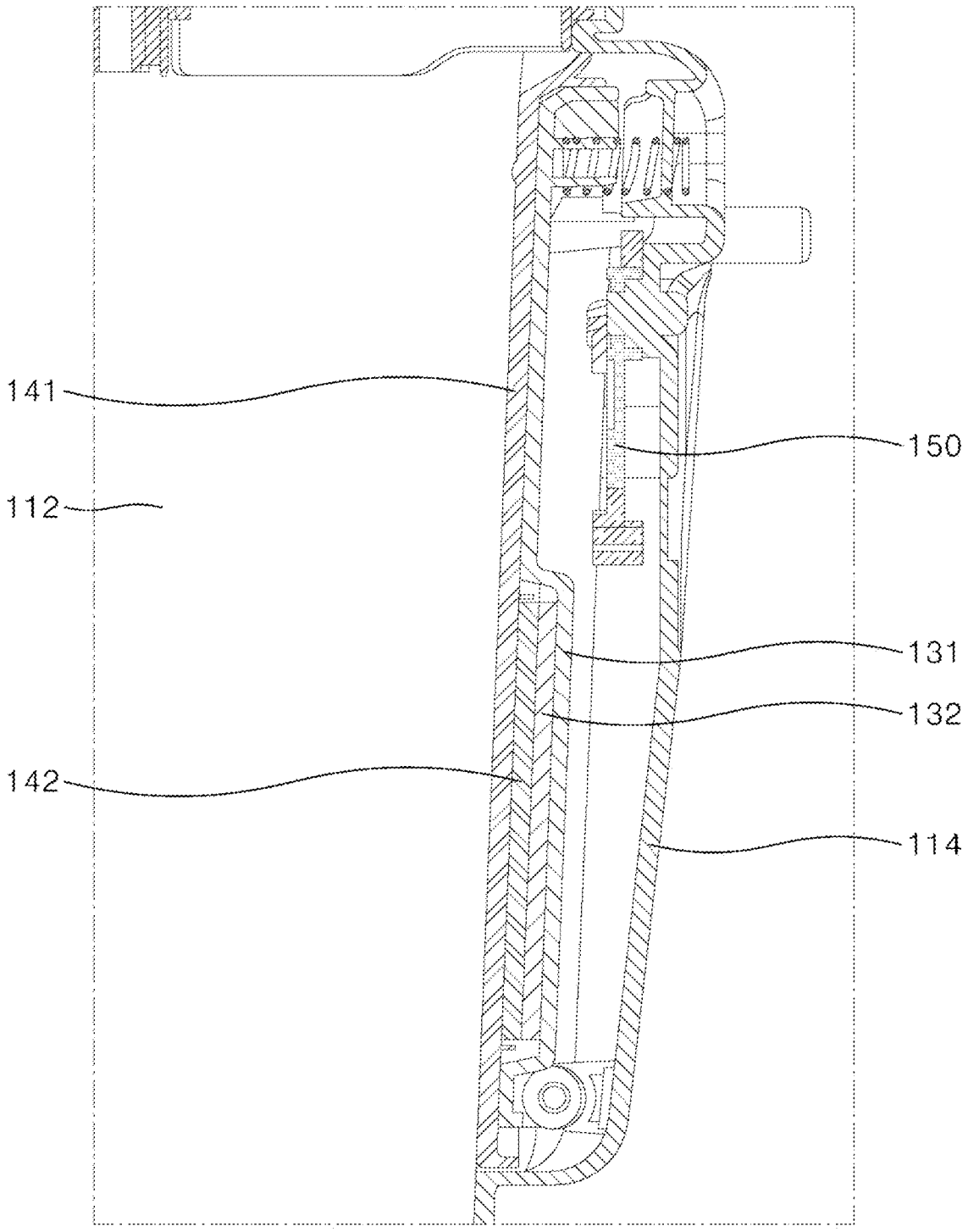
FIG. 5 is a cross-sectional view of the dispenser module shown in FIG. 1.

FIG. 2 is a front view of a dispenser module provided in the home appliance shown in FIG. 1. FIG. 3 is a front view of a state in which a cover is demounted from the dispenser shown in FIG. 2. FIG. 4 is an exploded perspective view of the dispenser module shown in FIG. 1. FIG. 5 is a cross-sectional view of the dispenser module shown in FIG. 1.

The dispenser module (dispenser) of the home appliance 1 according to this embodiment may include a dispenser housing 111 that defines an exterior design of the dispenser module; a dispenser nozzle 120 disposed in an upper area of the dispenser housing 111 and configured to dispense, for example, liquid, such as water, or ice; a dispenser button 131 disposed in the dispenser housing 111 and configure to operate the dispenser nozzle 120; and a button cover 140 detachably coupled to a front surface of the dispenser button 131 to cover the dispenser button 131.

The dispenser housing 111 may be made of a thin plate and formed in a shape of a standing bowl recessed backward (toward an inside of the refrigerator, in the case the home appliance is a refrigerator). The dispenser housing 111 may include a container accommodating portion 112 recessed backward to form a space capable of accommodating a container for liquid, such as water, or ice, for example, a cup; a support portion (support) 113 disposed on a lower surface of the container accommodating portion 112 to support the container or receive liquid, such as water, or ice; and a device accommodating portion further recessed from the container accommodating portion 112 to form a space in which a button operation device 150, described hereinafter, is accommodated.

The dispenser nozzle 120 may be configured to dispense liquid, such as water, or ice during operation. The dispenser nozzle 120 may be disposed in the upper area of the container accommodating portion 112 of the dispenser housing 111. The water or ice discharged from the dispenser nozzle 120 may be dispensed to the container disposed in the space defined by the container accommodating portion 112 of the dispenser housing 111.

The dispenser nozzle 120 may be disposed in front of and above the dispenser button 131. The dispenser nozzle 120 may have an outlet that discharges, for example, drinking water or ice that is disposed to face the support portion 113 of the dispenser housing 111.

The dispenser nozzle 120 may be operated by the dispenser button 131 to discharge liquid, such as water, or ice, when the dispenser button 131 is operated. The dispenser button 131 may be disposed in the container accommodating portion 112 of the dispenser housing 111. The dispenser button 131 may be in front of a device accommodating portion 114 of the dispenser housing 111. The dispenser button 131 may have a lower end rotatably coupled to the container accommodating portion 112 of the dispenser housing 111. The dispenser button 131 may be disposed so that an upper region of the dispenser button 131 may be inclined with respect to a lower region.

When the dispenser button 131 is tilted after being pushed, the dispenser nozzle 120 may be put into operation to dispense liquid, such as water, or ice therefrom. The dispenser button 131 may be mechanically connected with the button operation device 150. Due to this structure, when the dispenser button 131 is tilted, the button operation device 150 may be configured to generate an operation signal.

The button operation device 150 may be disposed in the space defined by the device accommodating portion 114 of the dispenser housing 111. The button operation device 150 may be positioned behind the dispenser button 131.

The button operation device 150 may be configured of various mechanical elements and/or electronic components in order to operate the dispenser nozzle 120 by the dispenser button 131 being pressed. The button operation device 150 may provide the dispenser button 131 with elasticity that acts in a forward direction. When the dispenser button 131 is tilted, the button operation device 150 may generate an operation signal.

The button cover 141 may be detachably coupled to a front surface of the dispenser button 131. The button cover 141 may be formed in a plate shape with an upright rectangular edge. The button cover 141 may be formed to have a larger area and a thicker thickness than the dispenser button 131 having the upright plate shape.

A rear surface of the button cover 141 may be recessed so that the dispenser button 131 may be inserted therein. The button cover 141 may cover a front surface and an edge area of the dispenser button 131 so as not to expose the dispenser button 131 to the outside. The button cover 141 may be disposed not to expose the device accommodating portion 114 defining the space accommodating the button operation device 140 to the outside. The button cover 141 may prevent liquid, such as water, or ice discharged from the dispenser nozzle 120 or liquid contained in a container from splashing and contacting the dispenser button 131, which results in preventing contamination of the dispenser button 131.

The button cover 140 may be configured to directly contact a container. When the user applies force to the button cover 140, the dispenser button 131 may be pressed and operated. As the button cover 140 may be washable, hygiene problems will not occur even in a case in which the button cover 140 comes into direct contact with the container.

The button cover 140 may be attached to the dispenser button 131 by a magnetic force. A magnet may be disposed in at least one of the button cover 140 or the dispenser button 131. In this embodiment, cover magnet 142 is provided in the button cover 140. Button magnet 132 is provided in the dispenser button 131, and the button magnet 132 and the cover magnet 142 are configured to act with an attractive force.

The cover magnet 142 may be coupled to a rear surface of the button cover 140. The dispenser button 131 may have a front surface partially recessed backward so that the button magnet 132 may be insertedly accommodated in the recessed space of the dispenser button 131.

The button cover 140 may be detached from the dispenser button 141 to be washed by the user. The washed button cover 140 may be reattached to the dispenser button 131.

The button cover 140 may be painted in a same or similar color as the dispenser housing 111. However, the dispenser button 131 may be painted in a completely different color from the dispenser housing 111, for example, a conspicuous yellow or red color or a contrasting color of the dispenser housing 111 so that the user may easily recognize that the button cover 140 is not attached.

Figure 6:
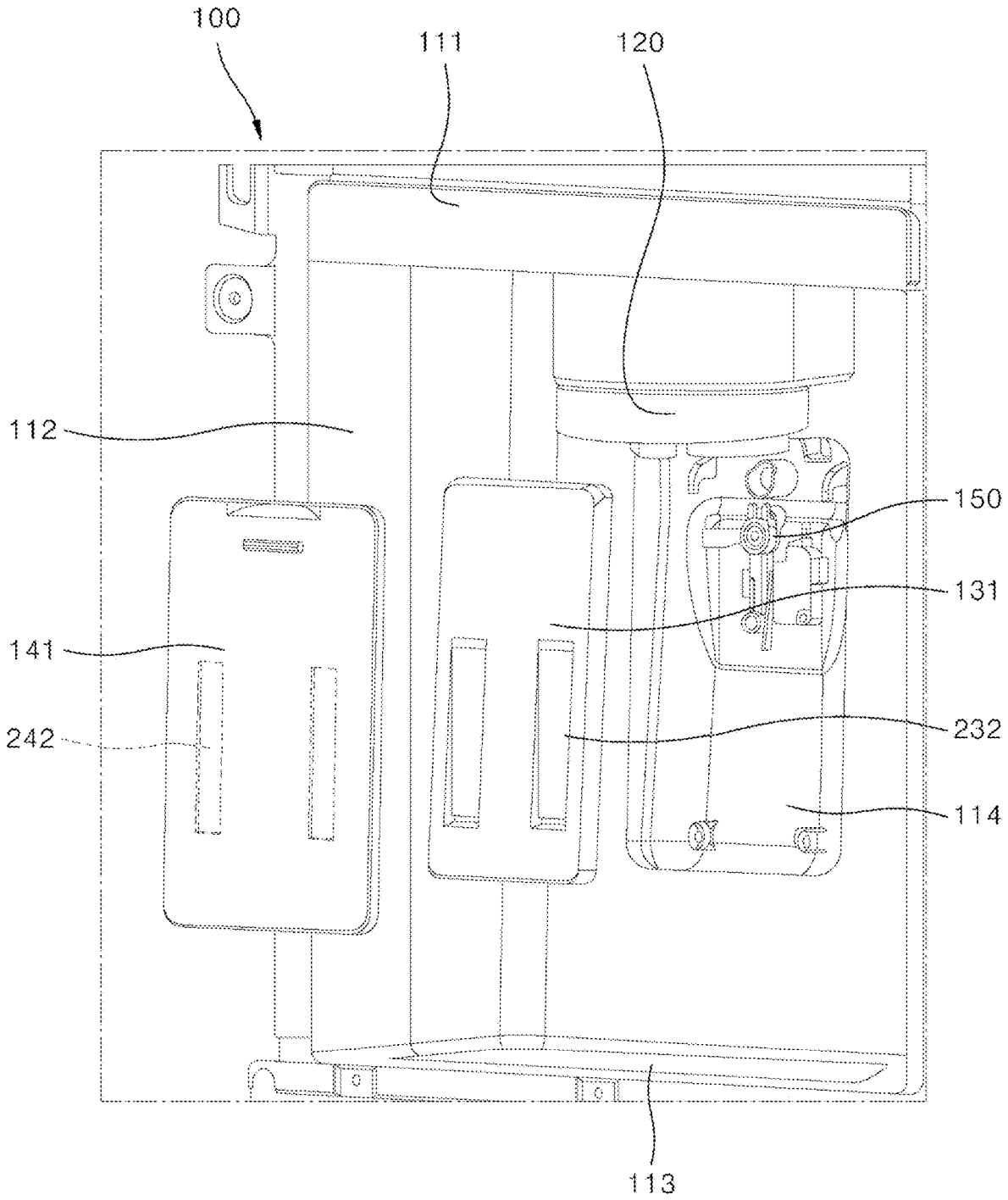
FIG. 6 is an exploded perspective view of a dispenser module according to another embodiment.

FIG. 6 is an exploded perspective view of a dispenser module according to another embodiment. Dispenser module 100 according to this embodiment may include a plurality of cover magnets 242 and a plurality of button magnets 232. The plurality of cover magnets 242 may be provided as a pair, and may be spaced a preset or predetermined distance apart from each other in a left-right or lateral direction, that is, a horizontal direction. The plurality of button magnets 232 may be provided in a pair, corresponding to the plurality of cover magnets 242, and may be spaced a preset or predetermined distance apart from each other in the left-right or lateral direction, that is, the horizontal direction.

According to this embodiment, the pair of cover magnets 242 may be spaced a preset or predetermined distance apart from each other in an upward-downward direction, that is, a vertical direction. The pair of button magnets 232 may be spaced a preset or predetermined distance apart from each other the up-down direction, that is, the vertical direction. According to an embodiment, the cover magnets 242 may be formed in a ring shape and may be disposed in or at an edge of the button cover 140. The button magnets 242 may be also formed in a ring shape and may be disposed in or at an edge of the dispenser button 131.

Figure 7:
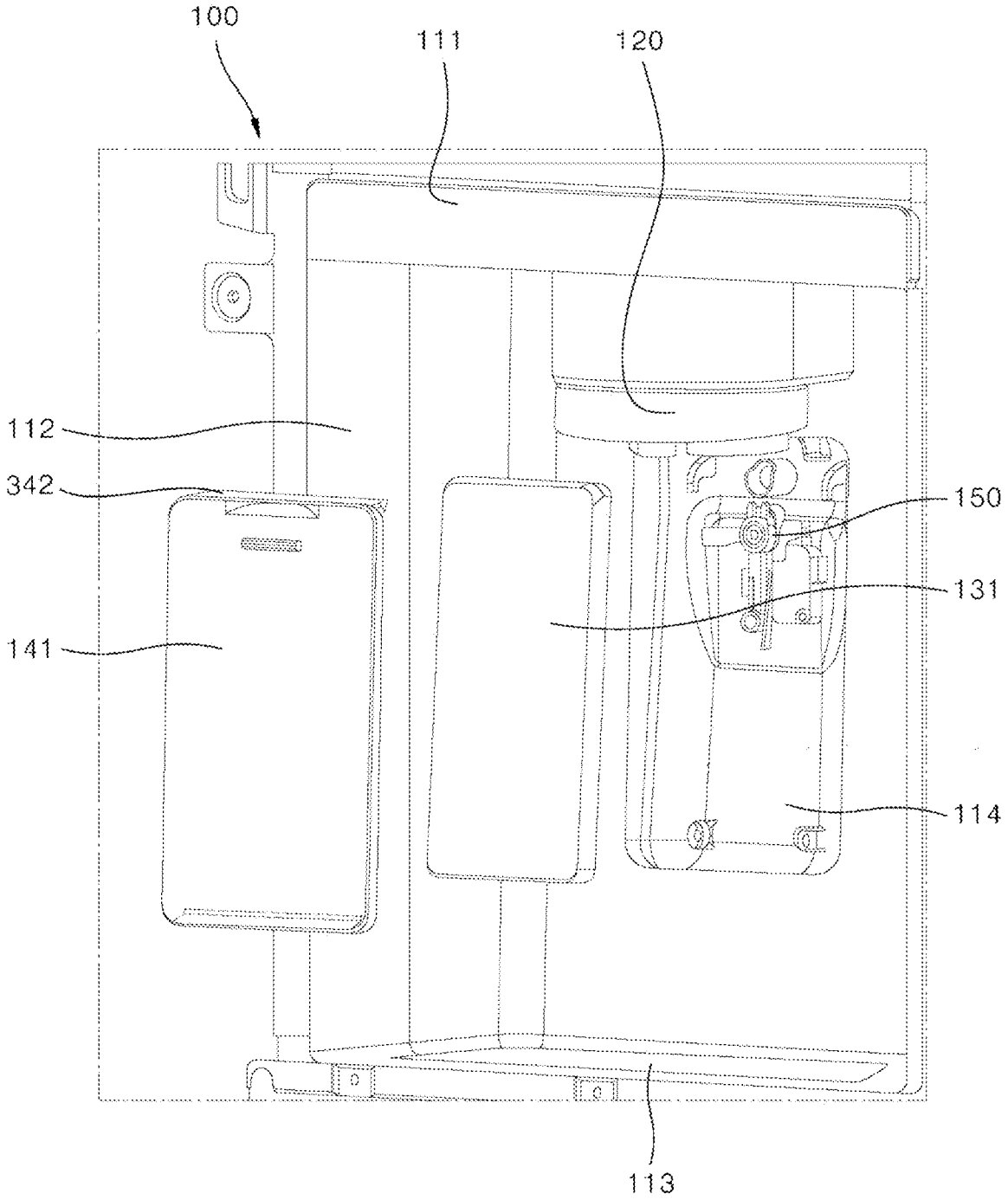
FIG. 7 is an exploded perspective view of a dispenser module according to yet another embodiment.

FIG. 7 is an exploded perspective view of a dispenser module according to yet another embodiment. Dispenser module 100 according to this embodiment may include a hook member (hook) 342 provided on at least one of the button cover 141 or the dispenser button 131 to be fitted to the other.

In this embodiment, the button cover 141 may be fitted to the dispenser button 131 by the hook member 342. The hook member 342 according to this embodiment may be formed in a hook shape that protrudes from an upper end and a lower end of the button cover 141. The hook member 342 may be hung on an upper end and a lower end of the dispenser button 131 to attach the button cover 141 to the dispenser button 131.

Embodiments disclosed herein provide a home appliance including a dispenser button that may be used hygienically.

Advantages are not limited to the above advantages, and other advantages that are not mentioned above may be clearly understood from the description and may be more clearly understood from the embodiments set forth herein.

Embodiments disclosed herein provide a home appliance that may include a dispenser housing recessed backward; a dispenser nozzle disposed in an upper area of the dispenser housing and configured to discharge liquid, such as water, or ice; a dispenser button disposed in the dispenser housing and configured to operate the dispenser nozzle; and a button cover detachably coupled to a front surface of the dispenser button and configured to cover the dispenser button.

The home appliance may further include a button operation device disposed behind the dispenser button and configured to operate the dispenser button when the dispenser button is pressed. The dispenser housing may define a space that accommodates the button operation device by being recessed backward, and the button cover may be disposed not to be exposed in the space accommodating the button operation device to the outside.

The button cover may be configured to cover the dispenser button from being exposed to the outside. The button cover may be formed in an upright plate shape and may have a rear surface recessed to receive the dispenser button inserted therein. The button cover may be configured to cover a front surface and an edge of the dispenser button.

The button cover may be attached to the dispenser button by a magnetic force. The home appliance may further include a cover magnet provided in the button cover; and a button magnet provided in the dispenser button and configured to act with an attractive force with the cover magnet.

The home appliance according to embodiments disclosed herein has at least one or more of the following advantages.

First, the home appliance has an advantage in that the cover of the dispenser button is detachable to be washed. Second, the home appliance has another advantage in that there is no waste of space and smooth operation of the button with a relatively simple structure, because the cover of the dispenser button is detachable. Third, the home appliance has a further advantage in that the button operation device is not contaminated with beverages, for example.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A home appliance, comprising:

a dispenser housing recessed into a door of the home appliance;

a dispenser nozzle disposed in an upper area of the dispenser housing and configured to discharge liquid or ice; a dispenser button disposed in the dispenser housing and configured to operate the dispenser nozzle; and a button cover detachably coupled to a front surface of the dispenser button and configured to cover the dispenser button, wherein the button cover is attached to the dispenser button by a magnetic force.

2. The home appliance of claim 1, further comprising: a button operation device disposed behind the dispenser button and configured to operate the dispenser nozzle when the dispenser button is pressed, wherein the dispenser housing defines a space that accommodates the button operation device by being recessed in the dispenser housing, and wherein the button cover is disposed so as not to expose the space accommodating the button operation device.

3. The home appliance of claim 1, wherein the button cover is configured to cover the dispenser button so that the dispenser button is not exposed.

4. The home appliance of claim 1, wherein the button cover is formed in an upright plate shape and has a rear surface recessed to receive the dispenser button inserted therein.

5. The home appliance of claim 1, wherein the button cover is configured to cover a front surface and an edge of the dispenser button.

6. The home appliance of claim 1, wherein the button cover is attached to the dispenser button by a magnetic force.

7. The home appliance of claim 1, further comprising:

at least one cover magnet provided in the button cover; and at least one button magnet provided in the dispenser button and configured to act with an attractive force with the at least one cover magnet.

8. The home appliance of claim 7, wherein the at least one cover magnet comprises a pair of cover magnets spaced a predetermined distance apart provided in the button cover, and wherein the at least one button magnet comprises a pair of button magnets spaced a predetermined distance apart provided in the dispenser button.

9. A home appliance, comprising:

a dispenser housing recessed into a door of the home appliance;

a dispenser nozzle disposed in an upper area of the dispenser housing and configured to discharge liquid or ice;

a dispenser button disposed in the dispenser housing and configured to operate the dispenser nozzle; and a button cover magnetically coupled to the dispenser button and configured to cover the dispenser button so that the dispenser button is not exposed, wherein the button cover is a plate, a rear surface of which is recessed to receive the dispenser button inserted therein.

10. The home appliance of claim 9, further comprising:

a button operation device disposed behind the dispenser button and configured to operate the dispenser nozzle when the dispenser button is pressed, wherein the dispenser housing defines a space that accommodates the button operation device by being further recessed, and wherein the button cover is disposed so as not to expose the space accommodating the button operation device.

11. The home appliance of claim 9, further comprising:

at least one cover magnet provided in the button cover; and at least one button magnet provided in the dispenser button and configured to act with an attractive force with the at least one cover magnet.

12. The home appliance of claim 11, wherein the at least one cover magnet comprises a pair of cover magnets spaced a predetermined distance apart provided in the button cover, and wherein the at least one button magnet comprises a pair of button magnets spaced a predetermined distance apart provided in the dispenser button.

13. A home appliance, comprising:

a dispenser housing recessed into a door of the home appliance;

a dispenser nozzle disposed in an upper area of the dispenser housing and configured to discharge liquid or ice; a dispenser button disposed in the dispenser housing and configured to operate the dispenser nozzle;

a button cover detachably coupled to a front surface of the dispenser button and configured to cover the dispenser button;

at least one cover magnet provided in the button cover; and at least one button magnet provided in the dispenser button and configured to act with an attractive force with the at least one cover magnet.

* * * * *